US007992972B2

(12) United States Patent
Shinbo et al.

(10) Patent No.: US 7,992,972 B2
(45) Date of Patent: Aug. 9, 2011

(54) METHOD OF MANUFACTURING LIQUID JET HEAD, METHOD OF MANUFACTURING PIEZOELECTRIC ELEMENT AND LIQUID JET APPARATUS

(75) Inventors: Toshinao Shinbo, Matsumoto (JP); Kazushige Hakeda, Shiojiri (JP); Koji Sumi, Nagano-ken (JP); Tsutomu Nishiwaki, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 322 days.

(21) Appl. No.: 12/405,984

(22) Filed: Mar. 17, 2009

(65) Prior Publication Data

US 2009/0262169 A1 Oct. 22, 2009

(30) Foreign Application Priority Data

Mar. 17, 2008 (JP) ..... 2008-067209
Dec. 26, 2008 (JP) ..... 2008-332955

(51) Int. Cl.
*B41J 2/045* (2006.01)

(52) U.S. Cl. ..... 347/71; 29/25.35; 438/50

(58) Field of Classification Search ..... 347/71, 347/68–69, 70, 72; 29/890.1, 25.35; 438/3, 438/50

See application file for complete search history.

(56) References Cited

U.S. PATENT DOCUMENTS

| | | | | |
|---|---|---|---|---|
| 6,884,649 | B2 * | 4/2005 | Kobayashi et al. | 438/50 |
| 7,399,067 | B2 * | 7/2008 | Kubota et al. | 347/70 |
| 7,475,967 | B2 * | 1/2009 | Nakagawa et al. | 347/68 |
| 2002/0084718 | A1 * | 7/2002 | Nakagawa et al. | 29/25.35 |

FOREIGN PATENT DOCUMENTS

| | | | |
|---|---|---|---|
| JP | 2003-298136 | A | 10/2003 |
| JP | 2004-111851 | A | 4/2004 |
| JP | 2008-016586 | A | 1/2008 |

* cited by examiner

*Primary Examiner* — K. Feggins

(74) *Attorney, Agent, or Firm* — Kilpatrick Townsend & Stockton LLP

(57) ABSTRACT

A method of manufacturing a piezoelectric element includes a piezoelectric layer forming step of sequentially and repeatedly performing a heat treatment step of applying a piezoelectric material containing lead to a lower electrode film at a relative humidity in the range of 30% to 50% Rh and then performing a heat treatment to form a piezoelectric precursor film and a crystallization step of firing the piezoelectric precursor film to form a piezoelectric film on the lower electrode film, thereby forming a piezoelectric layer.

7 Claims, 11 Drawing Sheets

METHOD OF MANUFACTURING LIQUID JET HEAD, METHOD OF MANUFACTURING PIEZOELECTRIC ELEMENT AND LIQUID JET APPARATUS

CROSS REFERENCES TO RELATED APPLICATIONS

The present application claims the priority based on Japanese Patent Application No. 2008-67209 filed on Mar. 17, 2008 and Japanese Patent Application No. 2008-332955 filed on Dec. 26, 2008, which are incorporated herein by reference.

BACKGROUND OF THE INVENTION

1. Field of the Invention

The present invention relates to a method of manufacturing a liquid jet head, a method of manufacturing a piezoelectric element, and a liquid jet apparatus.

2. Description of the Related Art

Piezoelectric elements for use in liquid jet heads and the like are elements in which a dielectric film formed of a piezoelectric material having an electromechanical transfer function is disposed between two electrodes, and the dielectric film is formed of, for example, crystallized piezoelectric ceramic.

As a method of manufacturing such a piezoelectric element, after a lower electrode film is formed on one side of a substrate (flow passage forming substrate) by a sputtering method or the like, a piezoelectric layer is formed on the lower electrode film by a sol-gel method, an MOD method, or the like, an upper electrode film is formed on the piezoelectric layer by a sputtering method, and the piezoelectric layer and the upper electrode film are patterned to form the piezoelectric element. Japanese Unexamined Patent Application Publications that disclose them are, for example, Japanese Unexamined Patent Application Publications Nos. 2003-298136 and 2004-111851.

In a sol-gel method of producing a piezoelectric layer, in general, after a solution prepared by dissolving an organometallic compound, such as a metal alkoxide, in an alcohol and adding a hydrolysis control agent and the like thereto is applied to a substrate on which a lower electrode film is formed, partial hydrolysis, dealcoholization polymerization, and dehydration polymerization reactions are allowed to proceed continuously by heating to form a three-dimensional network of metallic element-oxygen-metallic element, and sol shortly loses flowability thereafter to form gel, thus forming a precursor film of a piezoelectric substance. This step is performed at least once, and then heat treatment is performed at a high temperature for crystallization. These steps are repeatedly performed a plurality of times to produce a piezoelectric layer (piezoelectric thin film) having a predetermined thickness. On the other hand, in the MOD method, a step in which a solution of an organometallic compound is applied to a substrate, on which a lower electrode film has been formed, is dried, and is degreased to form a precursor film of a piezoelectric substance is performed at least once, and then heat treatment is performed at a high temperature for crystallization. These steps are repeatedly performed a plurality of times to produce a piezoelectric layer (piezoelectric thin film) having a predetermined thickness.

In the course of the formation of a piezoelectric thin film in manufacturing steps of such a piezoelectric element, the orientation of a piezoelectric thin film varies with the condition, such as humidity, and this disadvantageously affects piezoelectric characteristics.

To address such a problem, on the basis of the finding that a better piezoelectric thin film can be formed at a lower humidity, for example, Patent Document 1 employs a technique of adjusting an environment in which a piezoelectric thin film is formed to a humidity of 30% Rh or less.

Furthermore, Patent Document 2, for example, employs a technique of minutely setting the steps of forming a piezoelectric element and determining conditions, such as temperature and humidity, for each step, thus aiming at improving piezoelectric characteristics.

On the other hand, a piezoelectric element formed of a thin film tends to have cracks in the piezoelectric element, and there are problems about the incidence of cracks and the uniformity of in-plane properties.

Such problems exist not only in piezoelectric elements mounted on liquid jet heads, such as ink jet recording heads, but also in piezoelectric elements for use in any other apparatuses, including liquid jet apparatuses, as a matter of course.

SUMMARY OF THE INVENTION

The present invention has been achieved to solve at least part of the problems described above and can be implemented in accordance with the following embodiments or applications.

As an embodiment to which the invention is applied, a method of manufacturing a liquid jet head includes:

a lower electrode film forming step of forming a lower electrode film on one side of a flow passage forming substrate in which a flow passage is formed;

a heat treatment step of applying a piezoelectric material containing lead to the lower electrode film at a relative humidity in the range of 30% to 50% Rh and then performing a predetermined heat treatment to form a piezoelectric precursor film;

a crystallization step of firing the piezoelectric precursor film to form a piezoelectric film on the lower electrode film; and an upper electrode film forming step of forming an upper electrode film on the piezoelectric film.

Other features of the invention and objects thereof will more fully appear from the following description made in connection with the accompanying drawings.

BRIEF DESCRIPTION OF THE DRAWINGS

The invention and advantages thereof will be more fully understood from the following description and the accompanying drawings.

DETAILED DESCRIPTION OF PREFERRED EMBODIMENTS

Figure 1:
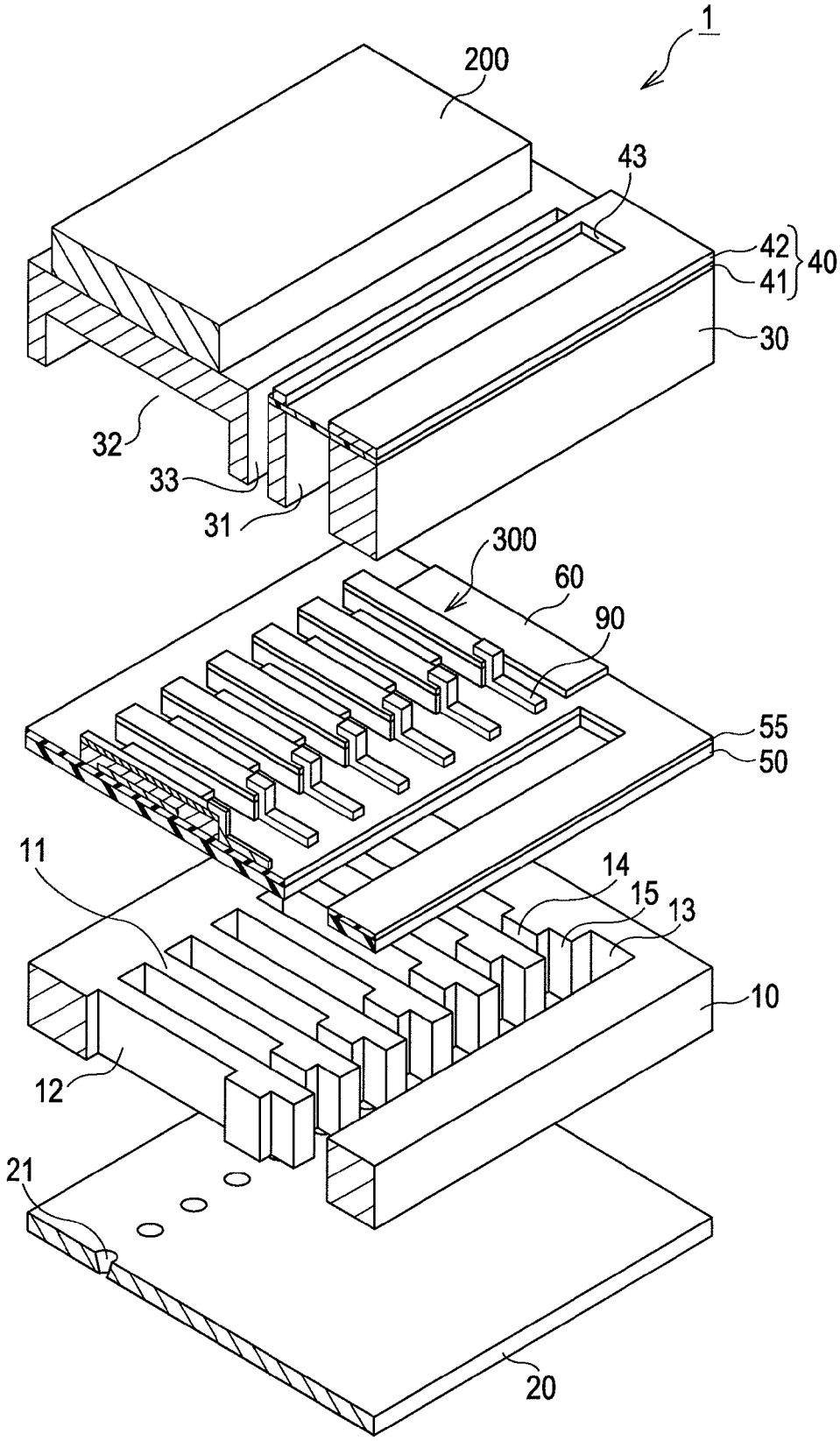
FIG. 1 is a schematic exploded perspective view of a recording head according to a first embodiment.

At least the following will become clear from the description of the present specification and the accompanying drawings. As an embodiment to which the invention is applied, a method of manufacturing a liquid jet head includes:

a lower electrode film forming step of forming a lower electrode film on one side of a flow passage forming substrate in which a flow passage is formed;

a heat treatment step of applying a piezoelectric material containing lead to the lower electrode film at a relative humidity in the range of 30% to 50% Rh and then performing a predetermined heat treatment to form a piezoelectric precursor film;

a crystallization step of firing the piezoelectric precursor film to form a piezoelectric film on the lower electrode film; and an upper electrode film forming step of forming an upper electrode film on the piezoelectric film.

In the heat treatment step, in which heat treatment is performed by removing an organic component contained in the piezoelectric material by heating, at least a step of drying a piezoelectric precursor film by heating is performed. Furthermore, a step of degreasing the piezoelectric precursor film by heating may be included.

In this case, the piezoelectric precursor film is preferably formed by a sol-gel method or an MOD method in the heat treatment step, and the piezoelectric material is preferably a ferroelectric containing at least Pb, Zr, and Ti. In this case, the piezoelectric material may include a case in which an additional metal oxide is added to a ferroelectric.

Furthermore, a method of manufacturing a liquid jet head according to the invention includes repeatedly performing the heat treatment step and the crystallization step of forming the piezoelectric film to form a piezoelectric layer composed of a plurality of piezoelectric films.

Since a method of manufacturing a liquid jet head according to the invention includes a heat treatment step of forming a piezoelectric precursor film at a relative humidity in the range of 30% to 50% Rh, both the generation of cracks in a piezoelectric layer due to the influence of humidity and the uniformity of in-plane properties can be stably maintained within a predetermined range.

A method of manufacturing a piezoelectric element according to the invention is a method of manufacturing a piezoelectric element composed of a lower electrode film, a piezoelectric layer, and an upper electrode film, and includes a lower electrode film forming step of forming a lower electrode film on one side of a substrate; a piezoelectric layer forming step of sequentially and repeatedly performing a heat treatment step of applying a piezoelectric material containing lead to the lower electrode film at a relative humidity in the range of 30% to 50% Rh and then performing a heat treatment to form a piezoelectric precursor film and a crystallization step of firing the piezoelectric precursor film to form a piezoelectric film on the lower electrode film, thereby forming a piezoelectric layer; and an upper electrode film forming step of forming an upper electrode film on the piezoelectric layer.

Since a piezoelectric film can be formed at a relative humidity in the range of 30% to 50% Rh by a method of manufacturing a piezoelectric element according to the invention as described above, a piezoelectric element having highly uniform in-plane properties can be manufactured while the generation of cracks in a piezoelectric layer is reduced.

A liquid jet apparatus according to the invention includes a liquid jet head manufactured by the manufacturing method described above or a piezoelectric element manufactured by the manufacturing method described above.

Since a liquid jet apparatus according to the invention as described above includes the liquid jet head or the piezoelectric element described above, a highly reliable liquid jet apparatus can be achieved.

Preferred embodiments of the invention will be described below with reference to the drawings. The following embodiments are described by way of example of the invention, and all the constituents described are not necessarily the essential components of the invention.

BEST EMBODIMENTS

Embodiments will be described below with reference to the drawings.

First Embodiment

Figure 2:
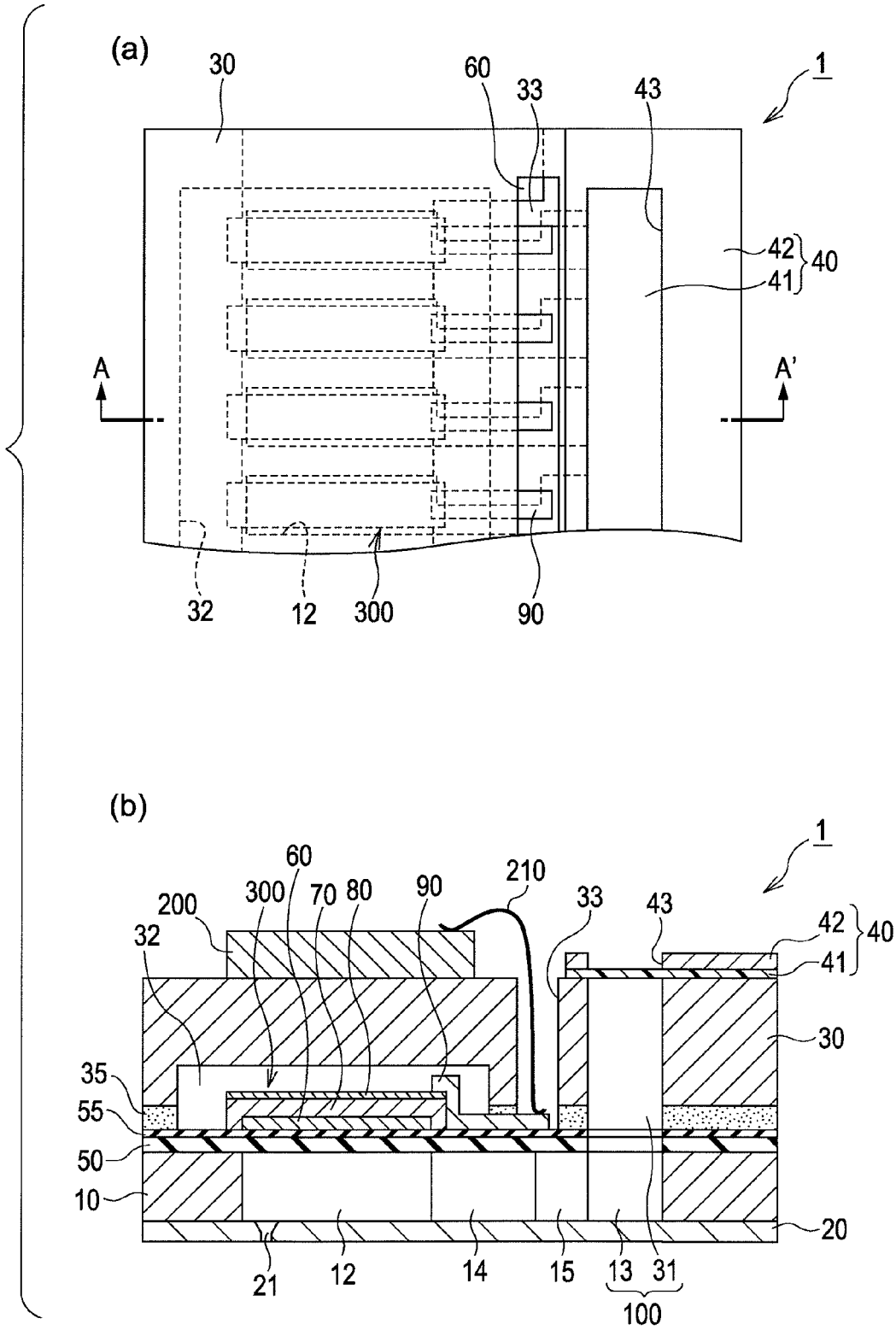
FIG. 2 shows a plan view and a cross-sectional view of the recording head according to the first embodiment.

FIG. 1 is a schematic exploded perspective view of an ink jet recording head 1, which is an example of a liquid jet head, according to a first embodiment of the invention, and FIGS. 2A and 2B are a plan view of FIG. 1 and a cross-sectional view taken along the line A-A' of FIG. 2A. In the present embodiment, a flow passage forming substrate 10 is formed of a silicon single crystal substrate whose surface has a crystal plane orientation of a (110) plane, and an elastic film 50 formed of an oxide film is formed on one side of the flow passage forming substrate 10.

The flow passage forming substrate 10 includes pressure generating chambers 12, which are divided by a plurality of partitions 11 by anisotropic etching from the other side, juxtaposed to each other in the width direction (transverse direction). Ink feed channels 14 and communication paths 15 are defined by the partitions 11 on one end of the pressure generating chambers 12 in the flow passage forming substrate 10 in the longitudinal direction. A communication portion 13, which constitutes a reservoir 100 serving as a common ink chamber (liquid chamber) of the pressure generating chambers 12, is formed on one end of the communication paths 15. Thus, the flow passage forming substrate 10 includes liquid flow passages composed of the pressure generating chambers 12, the communication portion 13, the ink feed channels 14, and the communication paths 15.

The ink feed channels 14 are in communication with one end of the pressure generating chambers 12 in the longitudinal direction and have a cross-sectional area smaller than the cross-sectional area of the pressure generating chambers 12. For example, in the present embodiment, the ink feed channels 14 having a width smaller than the width of the pressure generating chambers 12 are formed by narrowing the flow passages in the width direction between the reservoir 100 and the pressure generating chambers 12 in the proximity of the pressure generating chambers 12, and enter the pressure generating chambers 12 from the communication portion 13.

Thus, in the flow passage forming substrate 10, the liquid flow passages, which are composed of the pressure generating chambers 12, the ink feed channels 14 having a cross-sectional area smaller than the cross-sectional area of the pressure generating chambers 12 in the transverse direction, and the communication paths 15 being in communication with the ink feed channels 14 and having a cross-sectional area larger than the cross-sectional area of the ink feed channels 14 in the transverse direction, are divided by the plurality of partitions 11.

The opening surface of the flow passage forming substrate 10 is attached with an adhesive, a heat-seal film, or the like to a nozzle plate 20, which has nozzle openings 21 near the ends of the pressure generating chambers 12 opposite the ink feed channels 14. The nozzle plate 20 is formed of, for example, glass ceramic, a silicon single crystal substrate, or stainless steel.

As described above, the elastic film 50 is formed on the other side of the flow passage forming substrate 10 opposite the opening surface, and an insulator film 55 formed of an oxide film different from the material of the elastic film 50 is formed on the elastic film 50. A lower electrode film 60, a piezoelectric layer 70, and an upper electrode film 80 are stacked on the insulator film 55 in a process described below, forming a piezoelectric element 300. The piezoelectric element 300 refers to a portion that includes the lower electrode film 60, the piezoelectric layer 70, and the upper electrode film 80. In general, one of the electrodes of the piezoelectric element 300 is a common electrode, and the other electrode and the piezoelectric layer 70 are patterned for each of the pressure generating chambers 12. While the lower electrode film 60 is the common electrode of the piezoelectric element 300 and the upper electrode film 80 is the individual electrode of the piezoelectric element 300 in the present embodiment, for the convenience of a drive circuit or wiring, the lower electrode film 60 may be the individual electrode and the upper electrode film 80 may be the common electrode. A combination of the piezoelectric elements 300 and a diaphragm, which undergoes displacement by the operation of the piezoelectric elements 300, is herein referred to as an actuator. In the embodiment described above, while the elastic film 50, the insulator film 55, and the lower electrode film 60 function as a diaphragm, as a matter of course, the diaphragm is not limited to this; for example, in the absence of the elastic film 50 and the insulator film 55, only the lower electrode film 60 functions as the diaphragm. Alternatively, the piezoelectric elements 300 may also substantially function as the diaphragm.

The piezoelectric layer 70 is formed of a piezoelectric material exhibiting electromechanical transfer action, in particular, among piezoelectric materials, a ferroelectric material that has a perovskite structure and that contains Pb, Zr, and Ti as metals, formed on the lower electrode film 60. Suitable examples of the piezoelectric layer 70 include ferroelectric materials, such as lead zirconium titanate (PZT), and ferroelectric materials containing a metal oxide, such as niobium oxide, nickel oxide, or magnesium oxide. More specifically, lead titanate ($PbTiO_3$), lead zirconium titanate ($Pb(Zr,Ti)O_3$), lead zirconate ($PbZrO_3$), lead lanthanum titanate ($(Pb,La)TiO_3$), lead lanthanum zirconate titanate ($(Pb,La)(Zr,Ti)O_3$), or lead magnesium niobate zirconate titanate ($Pb(Zr,Ti)(Mg,Nb)O_3$) may be used.

The upper electrode film 80 serving as the individual electrode of the piezoelectric element 300 is connected to a lead electrode 90, for example, formed of gold (Au), which extends from the neighborhood of an end of the ink feed channels 14 to the insulator film 55.

A protective substrate 30 having a reservoir portion 31, which constitutes at least part of the reservoir 100, is attached with an adhesive 35 to the flow passage forming substrate 10 on which the piezoelectric elements 300 are formed, that is, to the lower electrode film 60, the insulator film 55, and the lead electrode 90. In the present embodiment, the reservoir portion 31 is formed through the protective substrate 30 in the thickness direction, extends in the width direction of the pressure generating chambers 12, and is, as described above, in communication with the communication portion 13 in the flow passage forming substrate 10, constituting the reservoir 100, which serves as a common ink chamber for the pressure generating chambers 12. The communication portion 13 in the flow passage forming substrate 10 may be divided so as to correspond to each of the pressure generating chambers 12, and only the reservoir portion 31 may function as a reservoir. Furthermore, for example, the flow passage forming substrate 10 may only include the pressure generating chambers 12, and a member between the flow passage forming substrate 10 and the protective substrate 30 (for example, the elastic film 50, the insulator film 55, etc.) may include ink feed channels 14 to connect the reservoir with the pressure generating chambers 12.

A region of the protective substrate 30 opposite the piezoelectric elements 300 includes a piezoelectric element holding portion 32, which has a space so as not to prevent the displacement of the piezoelectric elements 300. As long as the piezoelectric element holding portion 32 has a space so as not to prevent the displacement of the piezoelectric elements 300, the space may be sealed or not.

The protective substrate 30 is preferably formed of a material having substantially the same thermal expansion coefficient as the flow passage forming substrate 10, for example, a glass or ceramic material, and, in the present embodiment, is formed of a silicon single crystal substrate, which is the same material as the flow passage forming substrate 10.

The protective substrate 30 includes a through-hole 33 passing through the protective substrate 30 in the thickness direction. The neighborhoods of the ends of the lead electrodes 90 extending from the piezoelectric elements 300 are exposed in the through-hole 33.

A drive circuit 200 for driving the piezoelectric elements 300 juxtaposed to each other is fixed onto the protective substrate 30. For example, a circuit board or a semiconductor integrated circuit (IC) may be used as the drive circuit 200. The drive circuit 200 is electrically connected to the lead electrodes 90 via interconnecting wiring 210 using electroconductive wires, such as bonding wires.

The protective substrate 30 is attached to a compliance substrate 40, which includes a sealing film 41 and a fixing plate 42. The sealing film 41 is formed of a low-rigidity, flexible material (for example, a poly(phenylene sulfide) (PPS) film) and seals one side of the reservoir portion 31. The fixing plate 42 is formed of a hard material, such as metal (for example, stainless steel (SUS), etc.). Since a region of the fixing plate 42 opposite the reservoir 100 is completely removed in the thickness direction and forms an opening 43, one side of the reservoir 100 is sealed with the flexible sealing film 41 alone.

A method of manufacturing such an ink jet recording head 1 will be described below with reference to FIGS. 3 to 8. FIGS. 3 to 8 are cross-sectional views of a pressure-generating chamber in the longitudinal direction illustrating a method of manufacturing the ink jet recording head 1, which is an example of a liquid jet head according to an embodiment of the invention, and a method of manufacturing a piezoelectric element.

Figure 3:
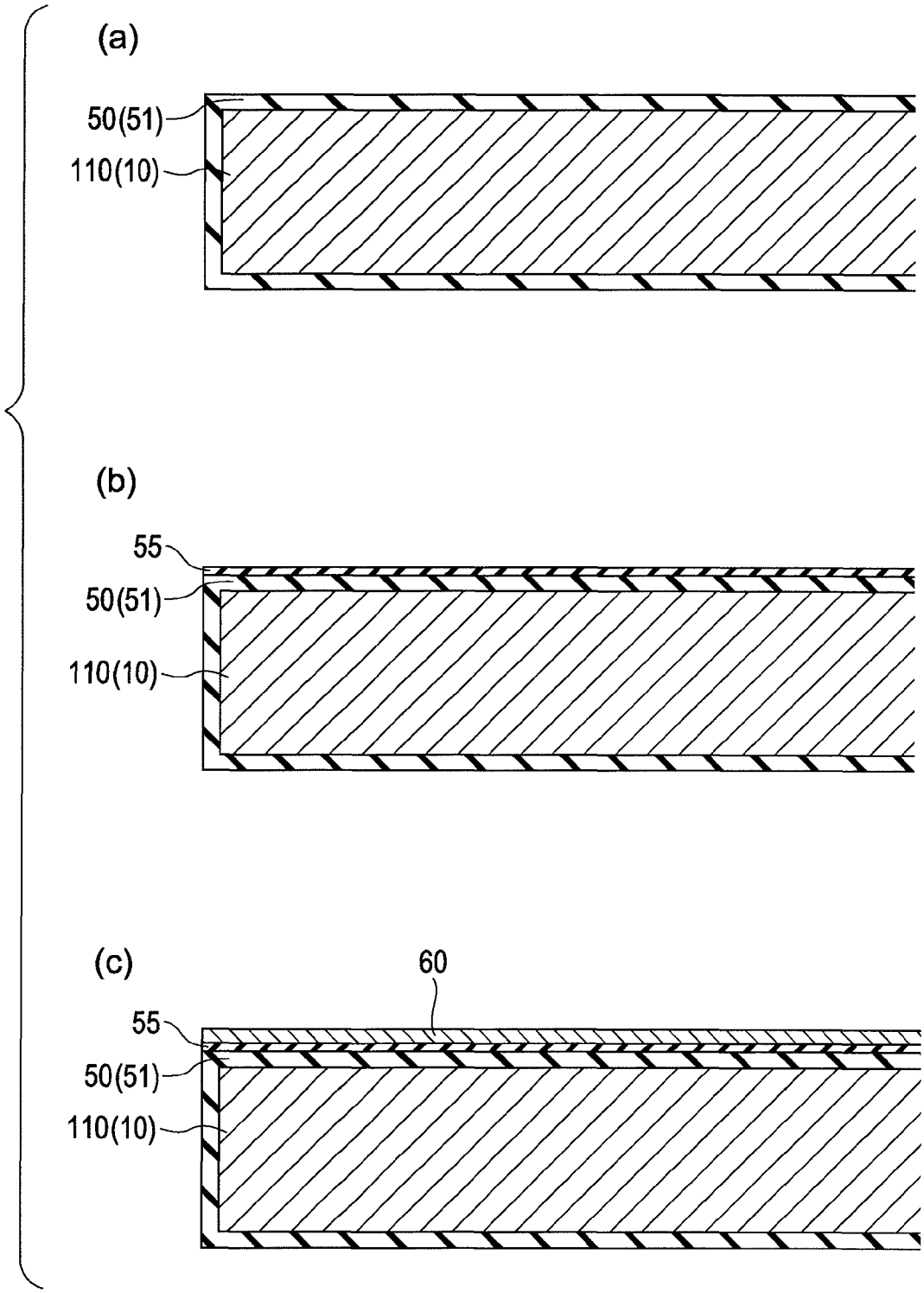
FIG. 3 shows cross-sectional views illustrating a method of manufacturing the recording head according to the first embodiment.

First, as illustrated in FIG. 3(*a*), an oxide film 51 constituting an elastic film 50 is formed on a surface of a wafer 110 for a flow passage forming substrate, which is a silicon wafer and on which a plurality of flow passage forming substrates 10 are to be integrally formed. The oxide film 51 may be formed by any method and is formed, for example, by subjecting the wafer 110 for a flow passage forming substrate to thermal oxidation in a diffusion furnace.

As illustrated in FIG. 3(*b*), an insulator film 55 formed of an oxide film, which is different from the material of the elastic film 50, is then formed on the elastic film 50 (oxide film 51). The insulator film 55 may be formed by any method and is formed, for example, by forming a zirconium (Zr) layer on the elastic film 50 (oxide film 51) followed by thermal oxidation in a diffusion furnace at a temperature, for example, in the range of 500° C. to 1200° C. to form the insulator film 55 formed of zirconium oxide ($ZrO_2$).

As illustrated in FIG. 3(*c*), a lower electrode film 60 is then formed on the insulator film 55. In the present embodiment, the lower electrode film 60 is mainly composed of at least iridium (Ir). The lower electrode film 60 may be formed, for example, by sputtering.

A piezoelectric layer 70 composed of lead zirconium titanate (PZT) is then formed. In the present embodiment, the piezoelectric layer 70 is formed by a so-called sol-gel method. The method of producing the piezoelectric layer 70 is not limited to the sol-gel method and may be a metal-organic decomposition (MOD) method.

Figure 4:
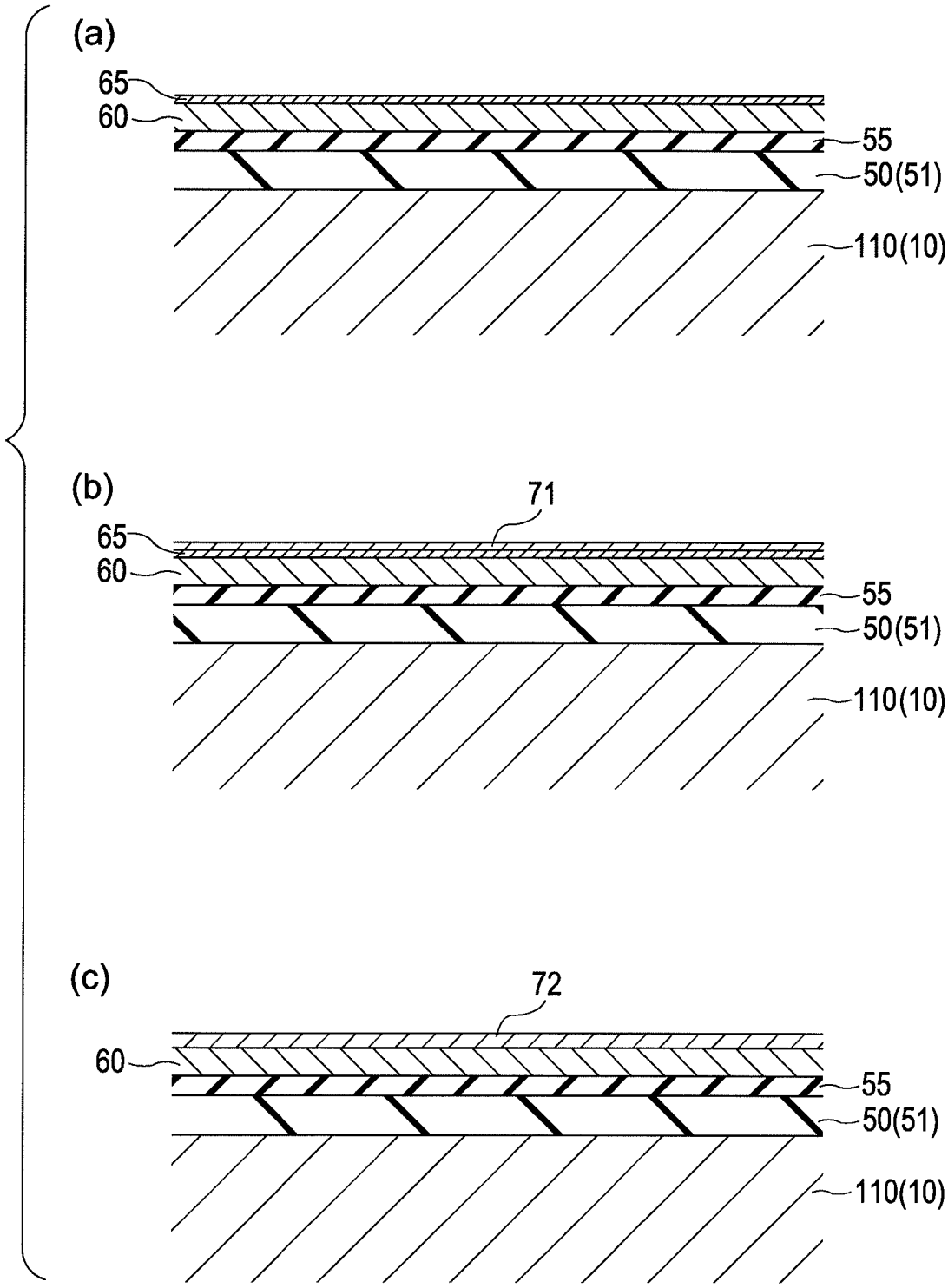
FIG. 4 shows cross-sectional views illustrating a method of manufacturing the recording head according to the first embodiment.

As a specific procedure for forming the piezoelectric layer 70, first, as illustrated in FIG. 4(*a*), a titanium layer 65 composed of titanium (Ti) is formed on the lower electrode film 60. The titanium layer 65 may be formed, for example, by a DC magnetron sputtering method. Preferably, the titanium layer 65 is amorphous. In the formation of the piezoelectric layer 70 on the titanium layer 65 disposed on the lower electrode film 60 in the subsequent step, because the titanium layer 65 can direct the preferred orientation of the piezoelectric layer 70 to (100) or (111), the piezoelectric layer 70 suitable as an electromechanical transducer can be produced. The titanium layer 65 functions as a seed for promoting crystallization in the crystallization of the piezoelectric layer 70 and diffuses in the piezoelectric layer 70 after the piezoelectric layer 70 is fired. The present embodiment assumes that the titanium layer 65 ranges from 4 to 6 nm.

As illustrated in FIG. 4(*b*), a piezoelectric precursor film 71 is formed on the lower electrode film 60 (titanium layer 65). More specifically, a sol (solution) containing a metal organic compound is applied to the flow passage forming substrate 10, on which the lower electrode film 60 has been formed (coating step). The piezoelectric precursor film 71 is then heated at a predetermined temperature for a given period of time for drying (drying step). The present embodiment assumes a two-stage drying step including bake 1 and bake 2.

The dried piezoelectric precursor film 71 is then heated at a predetermined temperature for a given period of time for degreasing (degreasing step). The degreasing herein means that organic components contained in the piezoelectric precursor film 71 are removed, for example, as $NO_2$, $CO_2$, $H_2O$, and the like.

In the present embodiment, a step in which organic components contained in the applied piezoelectric material are removed by heating to form the above-mentioned piezoelectric precursor film 71 is referred to as a heat treatment step. Thus, the heat treatment step in the present embodiment includes at least the coating step and the drying step to form the piezoelectric precursor film 71 and refers to a state in which the environment in the film formation is set such that the relative humidity in these steps is selected to range from 30% to 50% Rh. Preferably, the actual relative humidity is adjusted to about 40% Rh (see FIG. 9).

The present embodiment is based on the finding that the probability of occurrence of cracks increases with increasing humidity, whereas the uniformity of in-plane properties is improved at higher humidity, or the probability of occurrence of cracks decreases with decreasing humidity, whereas the uniformity of in-plane properties decreases with decreasing humidity. Thus, the present embodiment is based on the finding that the incidence of cracks and the uniformity of in-plane properties are in a trade-off relationship depending on the humidity environment in the film formation. The relationship between the uniformity of in-plane properties and the incidence of cracks affected by the relative humidity will be described in detail below.

While the heat treatment step described above includes the coating step and the drying step to form the piezoelectric precursor film 71, the heat treatment step according to the present embodiment is not limited to this and includes, for example, from the coating step to the degreasing step described above, and the humidity environment in the film formation may be set such that the relative humidity in these steps ranges from 30% to 50% Rh.

Alternatively, as described above, instead of the heat treatment step including the coating step, the drying step, and the degreasing step to form the piezoelectric precursor film 71, for example, up to the drying step may constitute a first heat treatment step, and only the degreasing step may constitute a second heat treatment step. Thus, the heat treatment step may be separated into stages to set the humidity environment in the film formation.

In the present embodiment, while the relative humidity between the steps in the above-mentioned heat treatment step is controlled within the range of 30% to 50% Rh, the relative humidity is not limited to this range, and, as a matter of course, the humidity environment may be controlled in a single step of from the coating step to the drying step and from the coating step to the degreasing step.

In the present embodiment, since the relative humidity in the film formation can be controlled within the range of 30% to 50% Rh by the heat treatment step described above, the piezoelectric precursor film 71 can be formed in a film forming environment in which cracks rarely occur and the uniformity of in-plane properties is stabilized.

As illustrated in FIG. 4(*c*), the piezoelectric precursor film 71 is then heated at a predetermined temperature for a given period of time for crystallization, thereby forming a piezoelectric film 72 (firing step). A heater used in the drying step, the degreasing step, and the firing step may be, for example, a hot plate or a rapid thermal processing (RTP) apparatus that is heated by infrared lamp irradiation.

In the present embodiment, the firing step described above is a crystallization step. More specifically, a step in which the piezoelectric precursor film 71 is crystallized to form the piezoelectric film 72 is the crystallization step. In the present embodiment, also in the crystallization step, as in the heat treatment step described above, the humidity environment in the film formation is set such that the relative humidity is selected to range from 30% to 50% Rh. Thus, the piezoelectric film 72 can also be formed from the piezoelectric precursor film 71 in a film forming environment in which cracks rarely occur and the uniformity of in-plane properties is stabilized.

Figure 5:
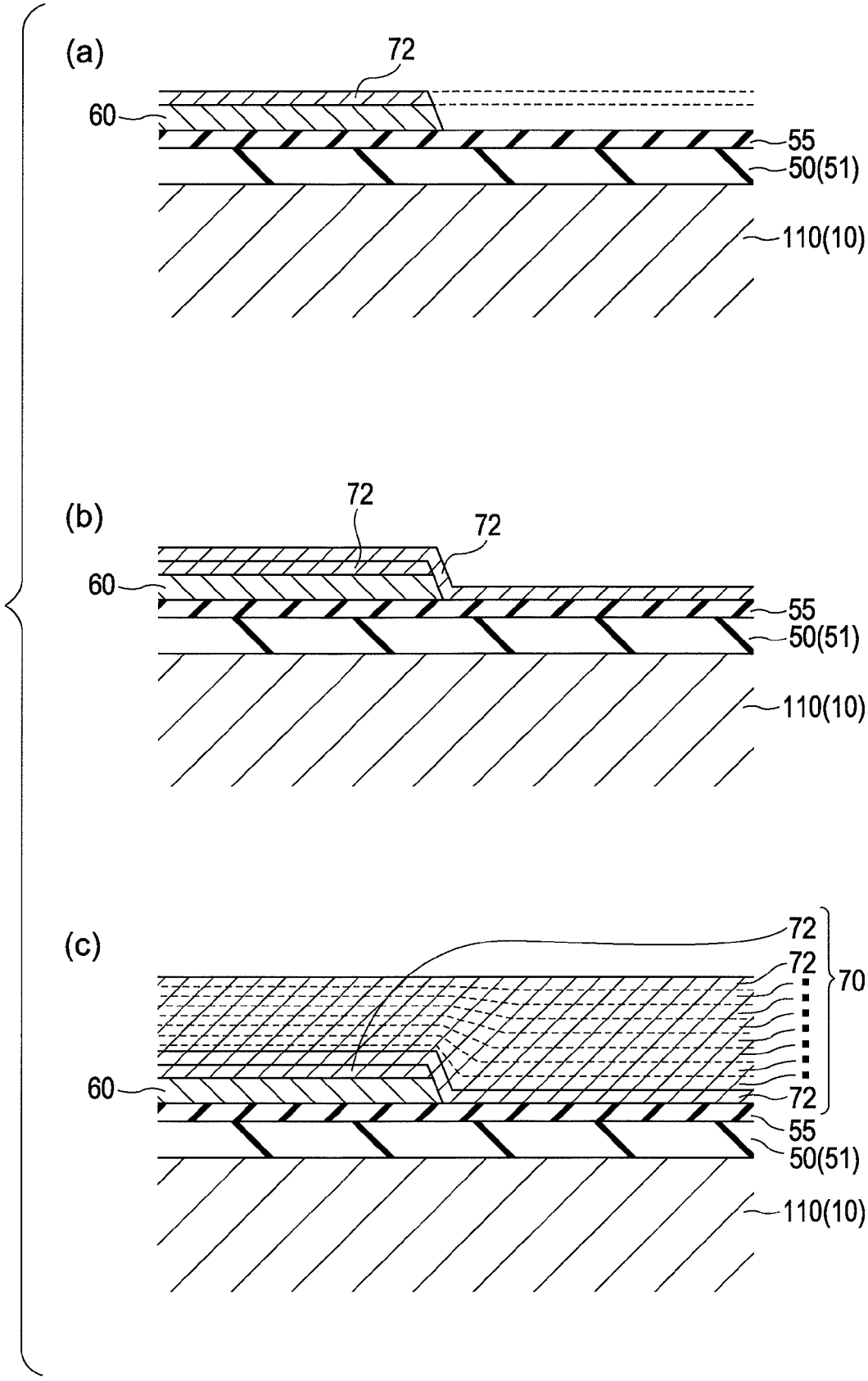
FIG. 5 shows cross-sectional views illustrating a method of manufacturing the recording head according to the first embodiment.

As illustrated in FIG. 5(*a*), after a first piezoelectric film 72 is formed on the lower electrode film 60, the lower electrode film 60 and the first piezoelectric film 72 are simultaneously patterned such that their side faces taper downward. Thus, in the formation of a second piezoelectric film 72, adverse effects on the crystallinity of the second piezoelectric film 72 due to different underlayers can be reduced or mitigated around a boundary between one portion in which the lower electrode film 60 and the first piezoelectric film 72 are formed and the other portion. Thus, crystals of the second piezoelectric film 72 can grow satisfactorily around a boundary between the lower electrode film 60 and a portion other than the lower electrode film 60, forming the piezoelectric layer 70 having high crystallinity. Furthermore, the inclination of the side faces of the lower electrode film 60 and the first piezoelectric film 72 can improve the adhesion of the second or upper piezoelectric film 72. Thus, a highly adhesive and reliable piezoelectric layer 70 can be formed. The patterning of the lower electrode film 60 and the first piezoelectric film 72 can be performed, for example, by dry etching, such as ion milling.

As illustrated in FIG. 5(*b*), the coating step, the drying step, the degreasing step, and the firing step described above are then sequentially performed on the wafer 110 for a flow passage forming substrate, including on the first piezoelectric film 72, to form the second piezoelectric film 72.

As illustrated in FIG. 5(*c*), the coating step, the drying step, the degreasing step, and the firing step described above are then sequentially performed on the second piezoelectric film 72 to form a plurality of piezoelectric films 72.

Figure 6:
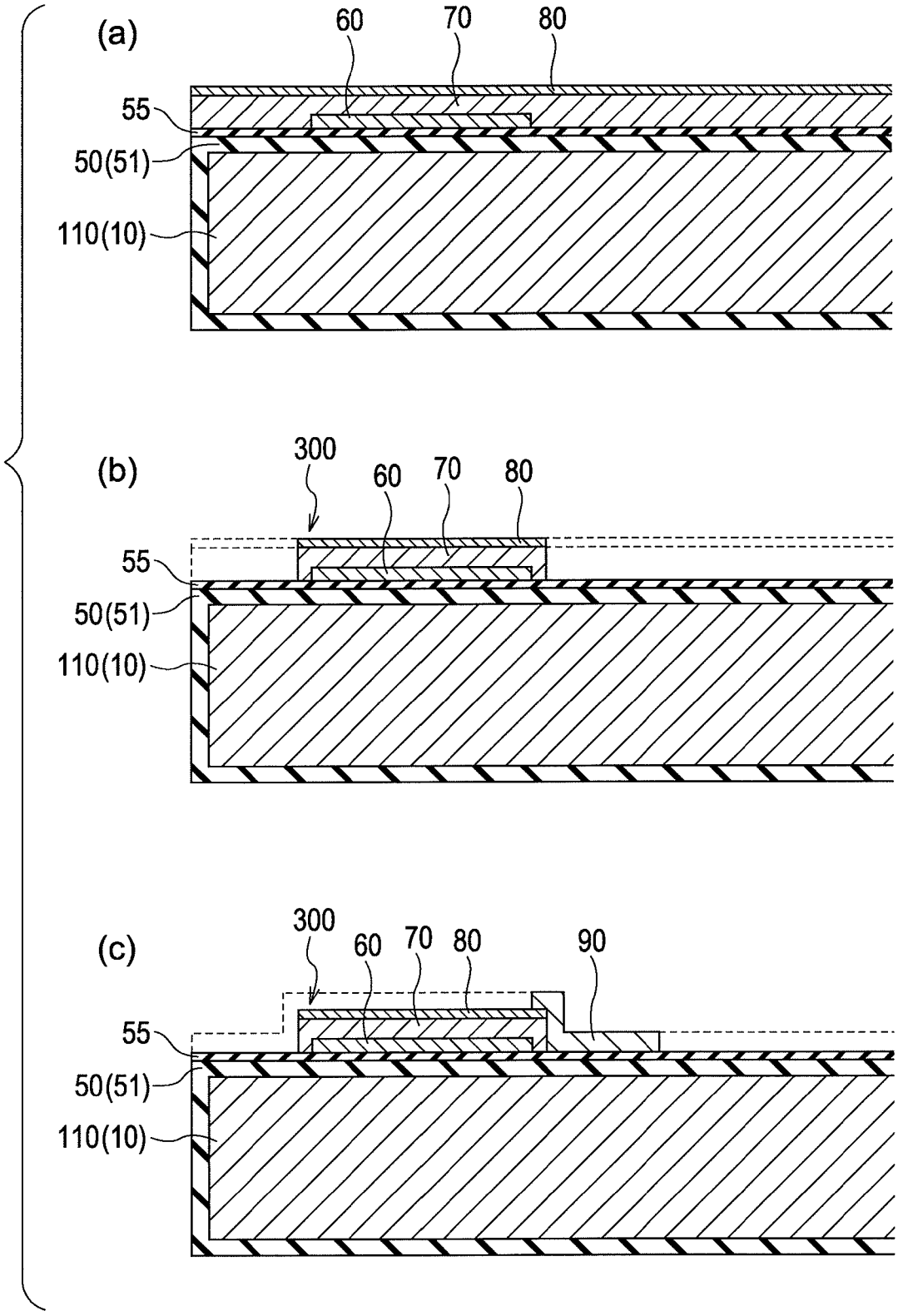
FIG. 6 shows cross-sectional views illustrating a method of manufacturing the recording head according to the first embodiment.

As illustrated in FIG. 6(*a*), an upper electrode film 80 formed of, for example, iridium (Ir) is then formed on the piezoelectric layer 70 composed of the plurality of piezoelectric films 72. As illustrated in FIG. 6(*b*), the piezoelectric layer 70 and the upper electrode film 80 are then patterned in a region opposite a pressure generating chamber 12 to form a piezoelectric element 300. The piezoelectric layer 70 and the upper electrode film 80 are patterned, for example, by dry etching, such as reactive ion etching or ion milling.

A lead electrode 90 is then formed. More specifically, as illustrated in FIG. 6(*c*), after a lead electrode 90 formed of, for example, gold (Au) is formed over the entire surface of the wafer 110 for a flow passage forming substrate, the lead electrode 90 is patterned for each piezoelectric element 300 using a mask pattern formed of, for example, a resist (not shown).

Figure 7:
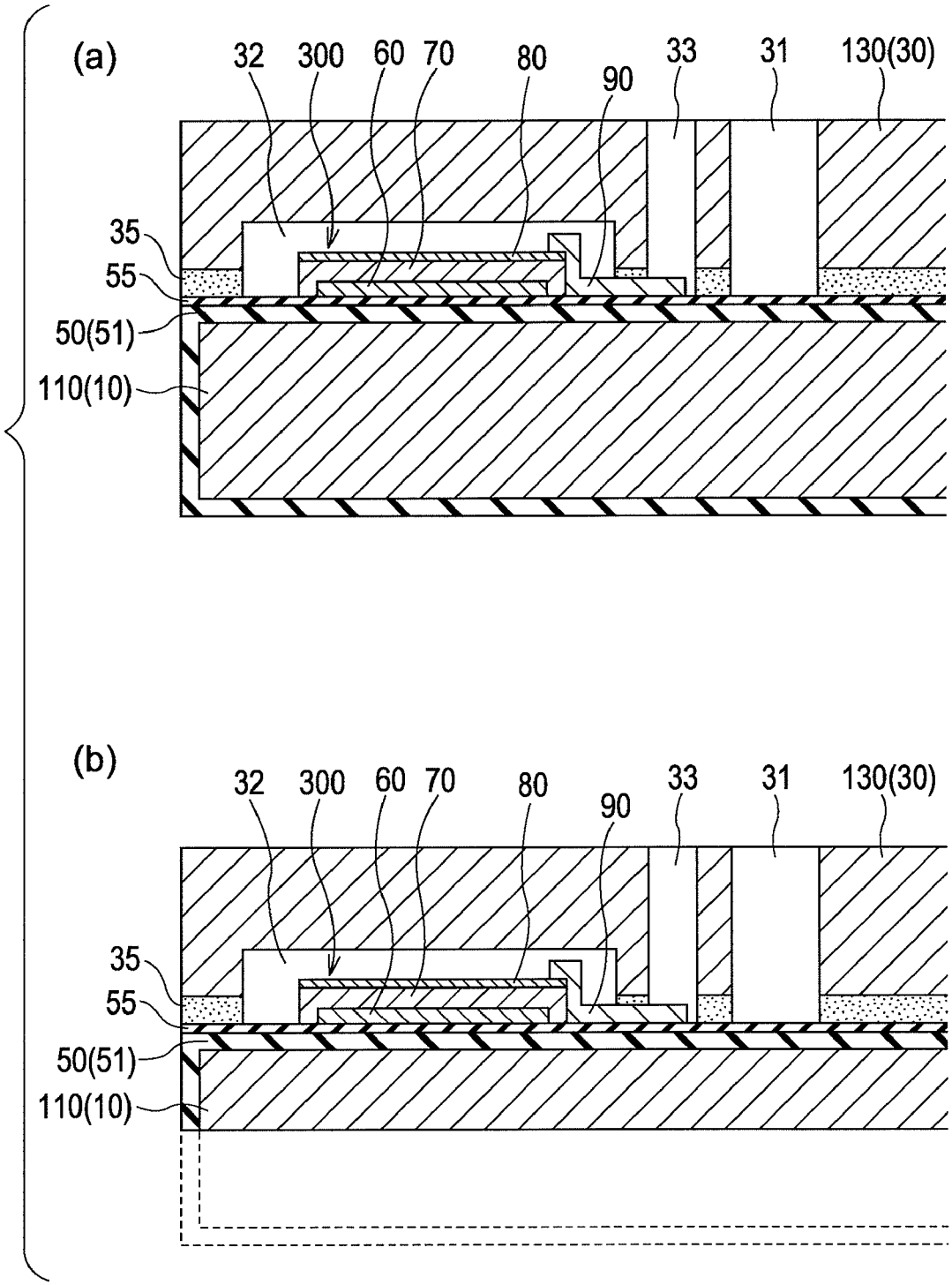
FIG. 7 shows cross-sectional views illustrating a method of manufacturing the recording head according to the first embodiment.

As illustrated in FIG. 7(*a*), a wafer 130 for a protective substrate, which is a silicon wafer and is to become a plurality of protective substrates 30, is then attached to the piezoelectric element 300 side of the wafer 110 for a flow passage forming substrate. As illustrated in FIG. 7(*b*), the thickness of the wafer 110 for a flow passage forming substrate is then reduced to a predetermined thickness.

Figure 8:
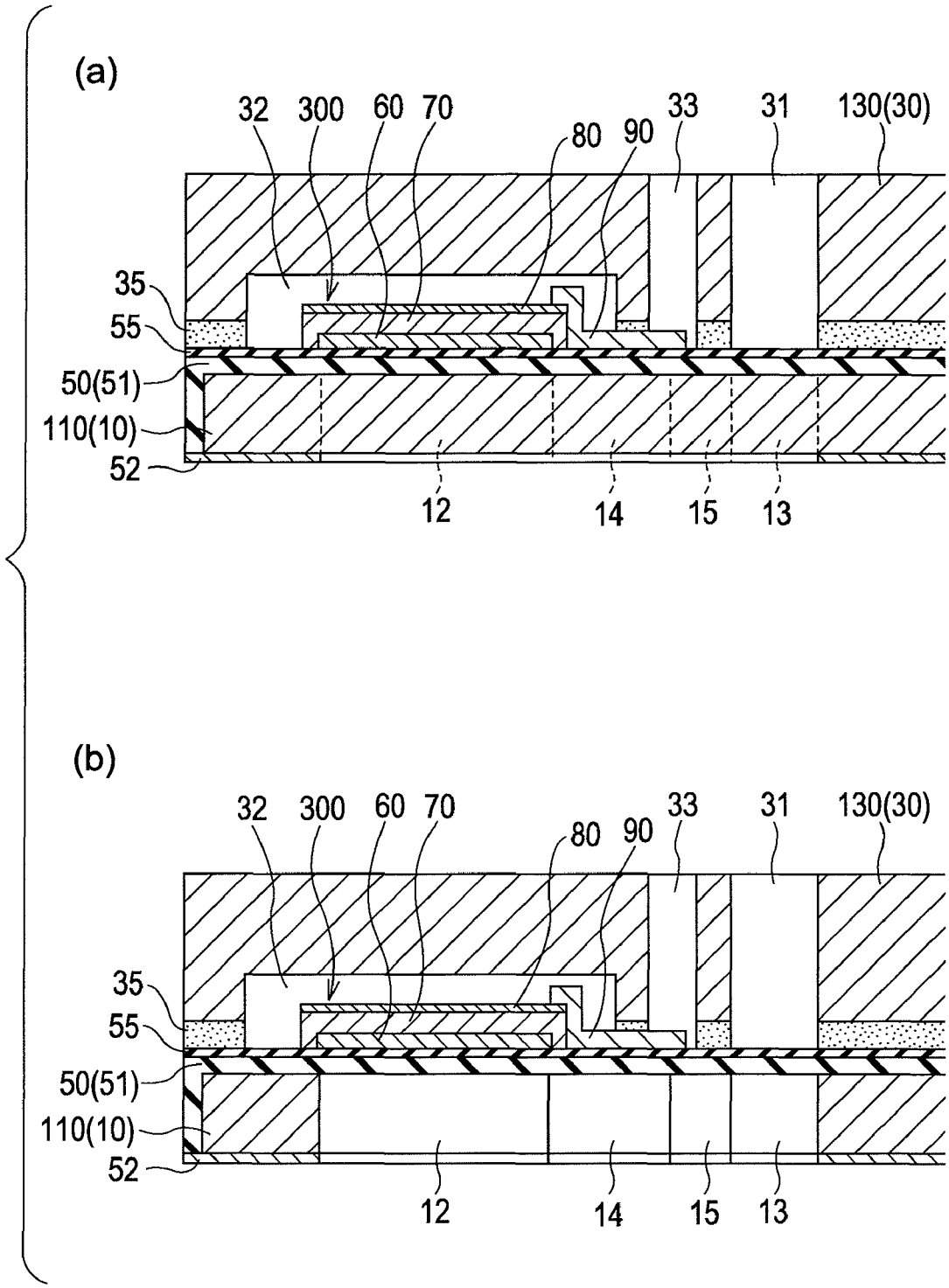
FIG. 8 shows cross-sectional views illustrating a method of manufacturing the recording head according to the first embodiment.

As illustrated in FIG. 8(*a*), a mask film 52 is then newly formed on the wafer 110 for a flow passage forming substrate and is patterned in a predetermined shape. As illustrated in FIG. 8(*b*), the wafer 110 for a flow passage forming substrate is then subjected to anisotropic etching (wet etching) using an alkaline solution, such as KOH, through the mask film 52 to form a pressure generating chamber 12, a communication portion 13, an ink feed channel 14, and a communication path 15 corresponding to the piezoelectric element 300.

Subsequently, unnecessary portions on the peripheries of the wafer 110 for a flow passage forming substrate and the wafer 130 for a protective substrate are removed, for example, by cutting, such as dicing. A nozzle plate 20 having nozzle openings 21 is attached to the side of the wafer 110 for a flow passage forming substrate opposite the wafer 130 for a protective substrate, a compliance substrate 40 is attached to the wafer 130 for a protective substrate, and the wafer 110 for a flow passage forming substrate is divided into flow passage forming substrates 10 of a chip size as illustrated in FIG. 1, thus producing an ink jet recording head 1 according to the present embodiment.

Figure 9:
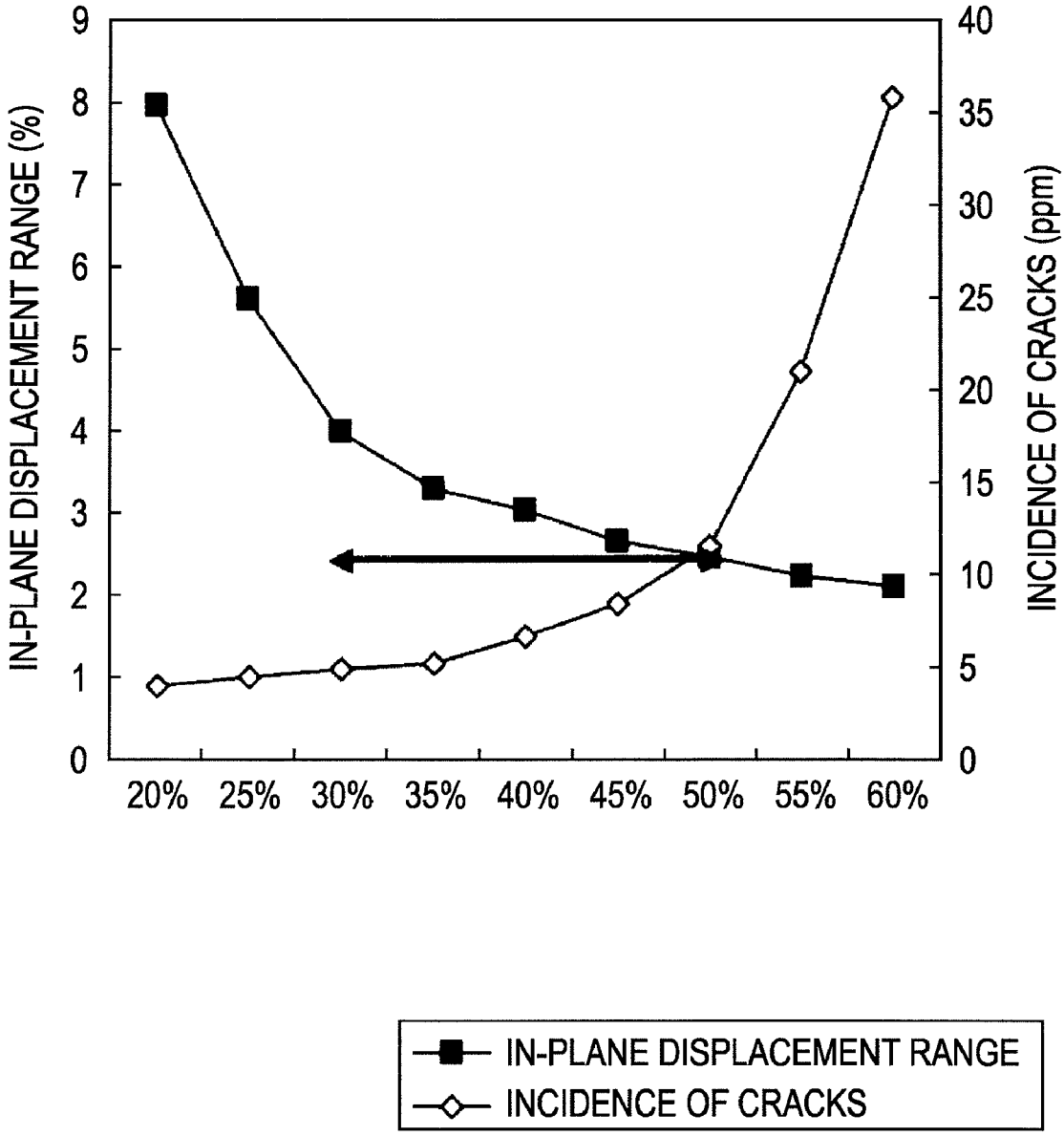
FIG. 9 is a graph showing the relationship between the uniformity of in-plane properties and the incidence of cracks.

The relationship between the uniformity of in-plane properties and the incidence of cracks based on the relative humidity described above will be described below. FIG. 9 is a graph showing the relationship between the uniformity of in-plane properties and the incidence of cracks based on variations in relative humidity in the film formation.

FIG. 9 is a graph based on the evaluation results shown in Table 1. Table 1 shows the evaluation results of a long-term durability test of a piezoelectric actuator that includes a piezoelectric film 72 formed by the steps described above.

TABLE 1

| Humidity | in-plane displacement range | Judgment | Incidence of cracks (seg/total seg number) | Judgment |
|---|---|---|---|---|
| 20% | 7.98% | Fail | 4.12 ppm | Pass |
| 25% | 5.62% | Fail | 4.53 ppm | Pass |
| 30% | 3.98% | Pass | 4.98 ppm | Pass |
| 35% | 3.31% | Pass | 5.22 ppm | Pass |
| 40% | 3.03% | Pass | 6.65 ppm | Pass |
| 45% | 2.66% | Pass | 8.41 ppm | Pass |
| 50% | 2.47% | Pass | 11.43 ppm | Pass |
| 55% | 2.24% | Pass | 20.97 ppm | Fail |
| 60% | 2.08% | Pass | 35.73 ppm | Fail |

The evaluation results of Table 1 and FIG. 9 show that both the uniformity of in-plane properties (displacement range) and the incidence of cracks are stable at a relative humidity in the range of 30% to 50% Rh.

The evaluation results also show that the probability of occurrence of cracks increases with increasing humidity and decreases with decreasing humidity. In other words, the incidence of cracks increases in a smooth curve with an increase in humidity, and the uniformity of in-plane properties (displacement range) decreases in a curve opposite to the curve indicating the incidence of cracks with a decrease in humidity.

It was also shown that the uniformity of in-plane properties (displacement range) is in a trade-off relationship with the incidence of cracks. More specifically, the uniformity of in-plane properties is high at high incidence of cracks (high humidity condition), and the uniformity of in-plane properties deteriorates at low incidence of cracks (low humidity condition). Thus, it was shown that the uniformity of in-plane properties (in-plane range) and the incidence of cracks are in a trade-off relationship under the humidity condition of the film formation.

The uniformity of in-plane properties (in-plane displacement range) has an influence on image quality, for example, when an image is formed on a recording sheet S with an ink jet recording apparatus described below, which is a liquid jet apparatus, and the incidence of cracks has an influence on the yield of a piezoelectric actuator including a piezoelectric film 72.

Evaluation results are shown in Table 1, in which in terms of image quality an image having no noticeable unevenness of printing was judged as "pass", and an image having noticeable and unacceptable unevenness of printing was judged as "fail". An acceptable decrease in yield was judged as "pass", and an unacceptable decrease in yield was judged as "fail".

Evaluation results show that unevenness of printing becomes noticeable in an image on a printed matter at an in-plane displacement range exceeding about 5%. Evaluation results also show that a decrease in yield is serious at an incidence of cracks exceeding about 20%.

The invention is based on the findings described above, and in particular the relative humidity in the heat treatment step (coating step and drying step, or coating step, drying step, and degreasing step) to form the piezoelectric precursor film 71 is set within the range of 30% to 50% Rh on the basis of the evaluation results described above. The relative humidity in the crystallization step (firing step) to form the piezoelectric precursor film 71 and the piezoelectric film 72 is also set within the range of 30% to 50% Rh. Thus, in the present embodiment, a piezoelectric film 72 that exhibits low incidence of cracks in a long-term durability test and high uniformity of in-plane properties can be formed.

As described above, in a method of manufacturing an ink jet recording head 1 according to the present embodiment, a piezoelectric material (in the present embodiment, a ferroelectric material, such as lead zirconium titanate (PZT)) was applied to the lower electrode film 60, a predetermined heat treatment was performed to form the piezoelectric precursor film 71, and the piezoelectric precursor film 71 was then fired for crystallization to form the piezoelectric film 72, thereby forming the piezoelectric layer 70 composed of a plurality of piezoelectric films 72 on the lower electrode film 60. In the present embodiment, the relative humidity in the formation of the piezoelectric layer 70 is set within the range of 30% to 50% Rh, and thereby the piezoelectric film 72 that exhibits low incidence of cracks and high uniformity of in-plane properties can be formed. Thus, an ink jet recording head 1 that includes the piezoelectric elements 300 having highly uniform in-plane properties can be manufactured while the generation of cracks in the piezoelectric layer 70 is reduced.

Figure 10:
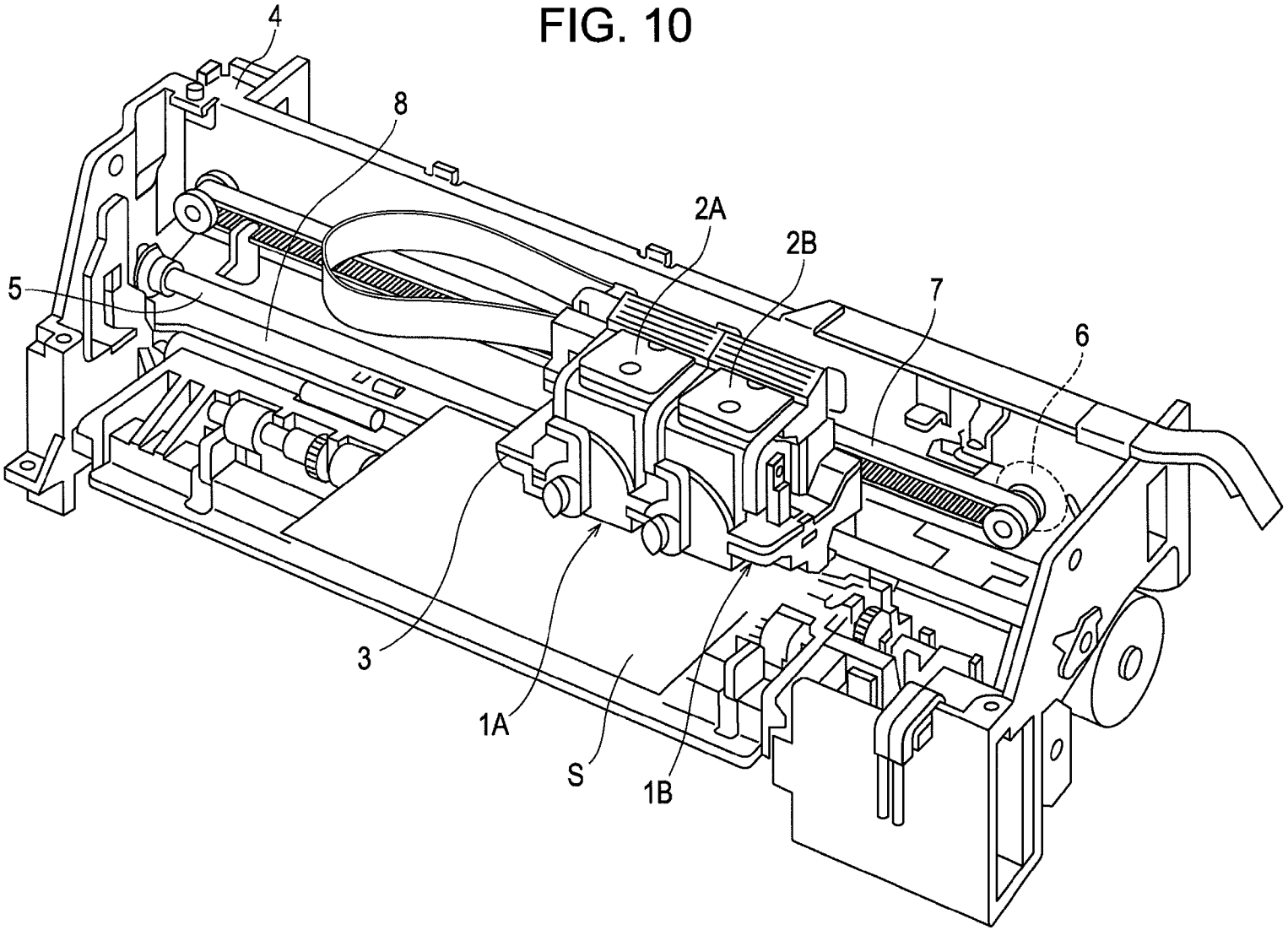
FIG. 10 is a schematic view of a recorder according to the first embodiment.

The ink jet recording head 1 that includes the piezoelectric elements according to the embodiment described above is installed in an ink jet recording apparatus, which is an example of a liquid jet apparatus, as one component of a recording head unit that includes an ink path in communication with an ink cartridge and the like. FIG. 10 is a schematic view of an example of the ink jet recording apparatus. As illustrated in FIG. 10, recording head units 1A and 1B, which include an ink jet recording head 1, house removable cartridges 2A and 2B, which constitute an ink supply unit, and a carriage 3, which includes the recording head units 1A and 1B, is mounted on a carriage shaft 5 attached to a main body 4 of the apparatus such that the carriage 3 can move in the axial direction. For example, the recording head units 1A and 1B eject a black ink composition and a color ink composition, respectively. When the driving force of a drive motor 6 is transferred to the carriage 3 via a plurality of gears (not shown) and a timing belt 7, the carriage 3 including the recording head units 1A and 1B is moved along the carriage shaft 5. The main body 4 of the apparatus includes a platen 8 along the carriage shaft 5, and a recording sheet S, which is a recording medium, such as paper, fed by a feed roller (not shown) is transported over the platen 8.

While FIG. 10 shows an ink jet recording apparatus as an example of a serial-type liquid jet apparatus, an ink jet recording apparatus serving as an example of a line-head-type liquid jet apparatus (line printer) may also be used.

Other Embodiments

Figure 11:
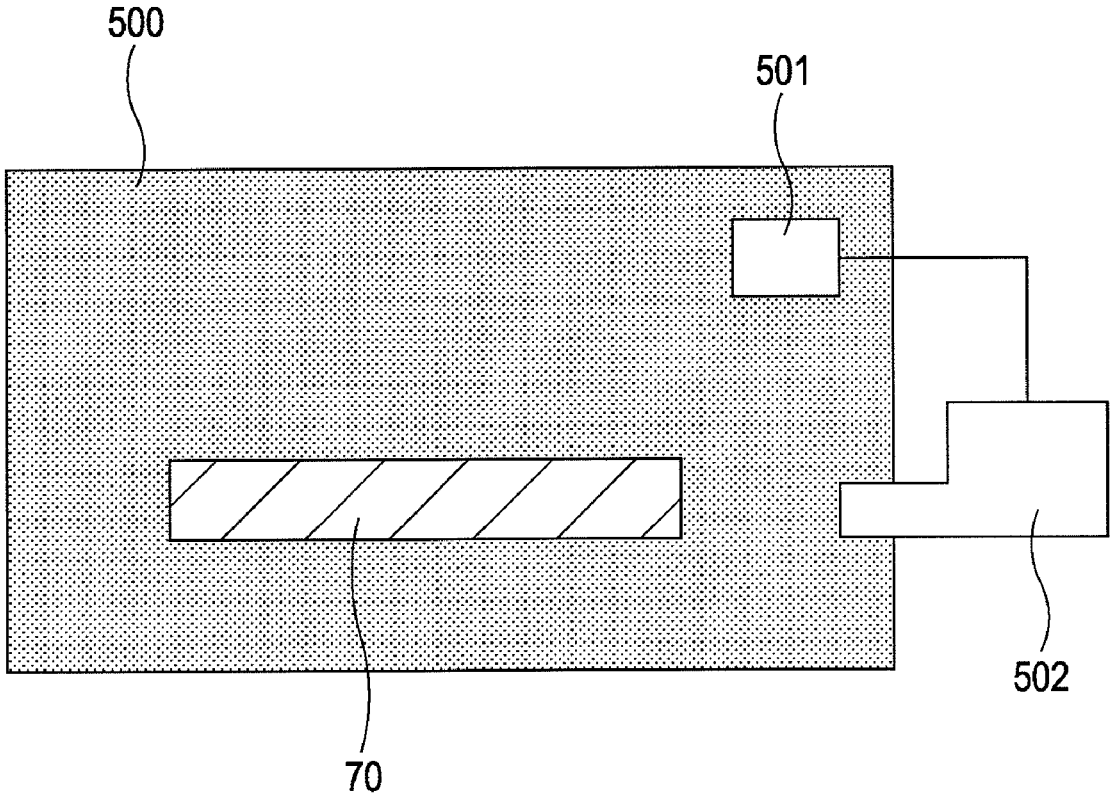
FIG. 11 is a schematic view of an apparatus for manufacturing a piezoelectric element according to another embodiment.

While an embodiment of the invention has been described above, the basic structure of the invention is not limited to the embodiment described above. For example, as exemplified in FIG. 11, a piezoelectric element manufacturing apparatus 500 may be fabricated, and a humidity control step may be provided to control the relative humidity in the formation of a piezoelectric layer 70 on a lower electrode film 60 within the range of 30% to 50% Rh in the heat treatment step and the crystallization step described above.

More specifically, the piezoelectric element manufacturing apparatus 500 includes a humidity sensor 501 and a humidity controller 502. The humidity sensor 501 and the humidity controller 502 are configured to implement the humidity control step described above.

The humidity sensor 501 and the humidity controller 502 control the relative humidity in the heat treatment step and the crystallization step described above within a predetermined range (in the present embodiment, within the range of 30% to 50% Rh). When the humidity sensor 501 detects the humidity in the piezoelectric element manufacturing apparatus 500, on the basis of the detection results, a control unit (not shown) outputs a drive signal to drive the humidity controller 502 such that the relative humidity ranges from 30% to 50% Rh. Thus, a piezoelectric element 300 can be formed while the relative humidity in the formation of the piezoelectric layer 70 is maintained within the range of 30% to 50% Rh.

While the silicon single crystal substrate having a crystal plane orientation of a (110) plane was exemplified as the flow passage forming substrate 10 in the embodiment described above, the flow passage forming substrate 10 is not limited to this and may be a silicon single crystal substrate having a crystal plane orientation of a (100) plane or may be formed of an SOI substrate or glass.

While the ink jet recording head has been described as an example of a liquid jet head in the embodiment described above, the invention is directed to a wide variety of general liquid jet heads and, as a matter of course, can be applied to liquid jet heads for ejecting liquid other than ink. Examples of other liquid jet heads include various recording heads for use in image recording apparatuses, such as a printer, coloring material ejecting heads for use in the manufacture of color filters for liquid crystal displays, electrode material ejecting heads for use in the formation of electrodes for organic EL displays, field emission displays (FEDs), and the like, and bioorganic compound ejecting heads for use in the manufacture of biochips.

The invention can be applied not only to a method of manufacturing a piezoelectric element installed in liquid jet heads, such as ink jet recording heads, but also to a method of manufacturing a piezoelectric element installed in other apparatuses. Furthermore, liquid jet apparatuses that include these liquid jet heads can be applied not only to ink jet recording apparatuses, but also to liquid jet apparatuses for ejecting liquid other than ink.

The invention claimed is:

1. A method of manufacturing a liquid jet head, comprising:

a lower electrode film forming step of forming a lower electrode film on one side of a flow passage forming substrate in which a flow passage is formed;

a heat treatment step of applying a piezoelectric material containing lead to the lower electrode film at a relative humidity in the range of 30% to 50% Rh and then performing a predetermined heat treatment to form a piezoelectric precursor film;

a crystallization step of firing the piezoelectric precursor film to form a piezoelectric film on the lower electrode film; and an upper electrode film forming step of forming an upper electrode film on the piezoelectric film.

2. A method of manufacturing a liquid jet head, in addition to the manufacturing method according to claim 1, comprising:

in the heat treatment step, in which heat treatment is performed by removing an organic component contained in the piezoelectric material by heating, performing at least a step of drying a piezoelectric precursor film by heating.

3. A method of manufacturing a liquid jet head, in addition to the manufacturing method according to claim 1, comprising:

forming the piezoelectric precursor film by a sol-gel method or an MOD method in the heat treatment step.

4. A method of manufacturing a liquid jet head, in addition to the manufacturing method according to claim 1, wherein the piezoelectric material is a ferroelectric containing at least Pb, Zr, and Ti.

5. A method of manufacturing a liquid jet head, in addition to the manufacturing method according to claim 1, comprising:

repeatedly performing the heat treatment step and the crystallization step of forming the piezoelectric film to form a piezoelectric layer composed of a plurality of piezoelectric films.

6. A liquid jet apparatus, comprising a liquid jet head manufactured by the manufacturing method according to claim 1.

7. A method of manufacturing a piezoelectric element that includes a lower electrode film, a piezoelectric layer, and an upper electrode film, comprising:

a lower electrode film forming step of forming a lower electrode film on one side of a substrate;

a piezoelectric layer forming step of sequentially and repeatedly performing a heat treatment step of applying a piezoelectric material containing lead to the lower electrode film at a relative humidity in the range of 30% to 50% Rh and then performing a heat treatment to form a piezoelectric precursor film and a crystallization step of firing the piezoelectric precursor film to form a piezoelectric film on the lower electrode film, thereby forming a piezoelectric layer; and an upper electrode film forming step of forming an upper electrode film on the piezoelectric layer.

* * * * *